US005437073A

United States Patent [19]

Smith

[11] Patent Number: 5,437,073

[45] Date of Patent: Aug. 1, 1995

[54] TUBE CLEANER

[76] Inventor: Graham H. Smith, 15 Randall Court, Collaroy Beach, New South Wales 2097, Australia

[21] Appl. No.: 955,898

[22] PCT Filed: May 17, 1991

[86] PCT No.: PCT/AU91/00216

§ 371 Date: Dec. 15, 1992

§ 102(e) Date: Dec. 15, 1992

[87] PCT Pub. No.: WO91/17843

PCT Pub. Date: Nov. 28, 1991

[30] Foreign Application Priority Data

May 18, 1990 [AU] Australia ..... PK0205

[51] Int. Cl.[6] ..... B08B 9/04

[52] U.S. Cl. ..... 15/104.061; 15/3.51

[58] Field of Search ..... 15/104.061, 104.062, 15/104.16, 104.031, 3.51, 3.5

[56] References Cited

U.S. PATENT DOCUMENTS

| | | | |
|---|---|---|---|
| 1,042,841 | 10/1912 | Thorsen | 15/104.16 |
| 1,547,440 | 7/1925 | Penn | 15/104.061 |
| 1,700,851 | 2/1929 | Oberhuber . | |
| 1,835,238 | 12/1931 | Oberhuber | 15/104.061 |
| 2,170,997 | 8/1939 | Griffin | 15/104.061 |
| 2,281,918 | 5/1942 | Constant et al. | 15/104.061 |
| 2,734,208 | 2/1956 | Griffin | 15/104.061 |
| 3,384,915 | 5/1968 | Rands . | |
| 3,460,180 | 8/1969 | Girard | 15/104.061 |
| 3,691,584 | 9/1972 | Landers . | |
| 3,850,311 | 4/1974 | Brandt . | |
| 3,871,139 | 3/1975 | Rands . | |
| 4,016,620 | 4/1977 | Powers | 15/104.061 |
| 4,083,074 | 4/1978 | Curtis | 15/104.061 |
| 4,413,370 | 11/1983 | Payne et al. . | |
| 4,937,907 | 7/1990 | Antal . | |
| 5,035,021 | 7/1991 | Le Devehat | 15/104.61 |

FOREIGN PATENT DOCUMENTS

| | | | |
|---|---|---|---|
| 584789 | 2/1925 | France . | |
| 2546774 | 12/1984 | France . | |
| 265048 | 10/1913 | Germany . | |
| 332905 | 2/1921 | Germany . | |
| 509604 | 9/1930 | Germany . | |
| 3541885 | 6/1987 | Germany . | |
| 391217 | 4/1933 | United Kingdom . | |
| 905007 | 9/1962 | United Kingdom | 15/104.061 |
| 1444496 | 7/1976 | United Kingdom . | |

*Primary Examiner*—Edward L. Roberts, Jr.
*Attorney, Agent, or Firm*—Cushman Darby & Cushman

[57] ABSTRACT

A tube cleaner (42) for removing deposits from the inner wall of condenser and other types of tubes has scrapers (20) for contacting the inner wall of the tube. The scrapers (20) are adapted to contact the wall so as to form an angle of 90 degrees or less rearwards of the scrapers (20) when the cleaner travels through the tube, so as to achieve more effective cleaning. The scrapers (20) may consist of one or more split rings mounted in incomplete transverse channels (44) on a central core (32).

13 Claims, 1 Drawing Sheet

TUBE CLEANER

This invention relates to a tube cleaning device; more particularly, this invention relates to a device suited to cleaning condenser and heat exchanger tubes, inter alia.

For the sake of brevity, this invention will generally be described in connection with tube cleaners for heat exchanger and condenser tubes. However, it is to be appreciated that the invention has application to a wide variety of tubes and that the scope of the invention is not limited to such cleaners.

Condenser and heat exchanger tubes are normally manufactured from materials such as brass, aluminium-brass, copper-nickel, titanium, stainless steel and carbon steel.

It is well known that tile operating efficiency of heat exchangers and condensers in power plants is reduced and fluid flow is restricted when the condenser tubes become fouled by such deposits as scale, algae, mud, slime and the like. In addition, if tubes are not cleaned regularly, deposits may cause pitting or corrosion of the tubes, resulting in major damage and shortened tube life.

Deposits in tubes can be classified loosely as two types: soft deposits, such as algae, mud and slime, and hard deposits, such as scale. The soft deposits may be loosened or even removed by using high pressure water alone, but removal is most effective if high pressure water is combined with some abrasive action. Hard deposits need a positive abrasive action; water is useful mainly to flush out the hard deposits once they lave been scraped from the tube wall, and to remove acidic deposits found under pitting peaks.

To clean the tubes, various systems have been devised. Many of these involve the propulsion of a cleaning projectile through time tubes. Propulsion is effected by means of an air, water or air/water gun which shoots the projectile through the tube. Over the years, time projectiles have included rubber scraper plugs, balls and brushes and may be propelled through the tubes.

In recent years, more sophisticated propelled tube cleaners have been devised. One such tube cleaner, designed for use with a water gun, comprises a metal core on which are mounted a series of spring-loaded metal scraper blades. Each blade is designed to make contact with part of the arc of the tube wall's diameter, by forming an obtuse angle with time wall. Time blades are fixed in position around the metal core so that their arcs overlap and all the circumference of a tube wall is intended to be contacted by at least one blade as the cleaner progresses through the tube.

This cleaner is designed to remove obstructions and debris as well as all deposits, including soft deposits and hard scale from the tube wall. It will be appreciated that time cleaner has a certain degree of body strength and this is required in order to remove hard scale effectively. Material removed by the scraper blades is swept through the tube by the water used to propel the cleaner.

This prior art cleaner may be reusable for up to 20 times; however, depending on the nature of the deposits, the life of the cleaner may be reduced to 8 to 10 uses. In addition, this cleaner suffers from the disadvantage that the metal blades may corrode unless cared for in a proper manner. Further, the fit between the tube wall and the scraper blades must be a close one for the cleaner to operate efficiently. There is very little tolerance for variations in the diameter of the tube. Therefore, this cleaner is not adaptable for use with tubes which vary in size, even within a small range of gauge.

This can be a significant problem. Many tubes have a plastic or other lining running from the inlet into the tube for a short way, to prevent water erosion of the tube. If the prior art tube cleaner referred to above is chosen to fit the lined part of the tube, there may be insufficient contact between the scraper blades and the unlined length of the tube to effect proper cleaning. On the other hand, if the tube cleaner is chosen to fit the unlined length of the tube, there will be a tight fit between the cleaner and the lined part of the tube and use of the cleaner may damage the lining, especially in the case of plastic linings.

In addition, many cleaners are not intended for use in other than straight tubes.

Another type of tube cleaner now available consists of a scrubber made of semi-rigid plastic such as polyethylene and consists of a core body and a series of scraping discs integral therewith. This scrubber is designed for use with air and water guns: the scrubber channels the water through apertures in the scrubber, so that deposits may be loosened and swept out of the tube. The scraping discs which are designed to meet the tube at an obtuse angle, are relatively flexible and can adjust to the diameter of the tube. In a situation where the inlet and outlet of the tube is lined, as described above, the flexibility of the discs and the use of plastic rather than metal in the scraping discs means that there is little likelihood of damaging the plastic lining, while at the same time there is an adequate fit with the unlined part of the tube.

While each scrubber is relatively inexpensive and adaptable to be used in tubes having a small variation in diameter, as indicated above, it is necessary to use different sized scrubbers if there is a larger variation in diameter. In addition, the scrubber may have a short life, especially if hard deposits are frequently encountered.

The polyethylene scrubber suffers from a further disadvantage: some water contains a significant amount of mineral salts and leaves stubborn scale on tubes. It has been found that the polyethylene scrubber has insufficient body strength to remove this.

Both the prior art cleaners described in detail above are vulnerable to damage if they hit a solid obstacle. The metal cleaners wear and riveting becomes loose, with the result that the cleaners are ineffective after about 10 uses. The plastic scrubbers break and must be discarded.

The above description relates to heat exchange and condenser tubes. However, there is a different type of problem encountered in the case of some other types of tubes, such as chiller sets for air conditioning plant. The tube bores in these situations are not always of constant diameter. At present, it is common to use a brush driven by a flexible cable to clean these tubes, the cable causing the brush to rotate as it travels through the tube. However, these flexible brushes, whose bristles are dragged back against the wall of the tube during the cleaning operation, wear rapidly and require replacement frequently.

It is an aim of the present invention to provide a tube cleaner which, in particular embodiments, substantially overcomes or at least alleviates some or all of the drawbacks presented by prior art tube cleaners and which incorporates other advantages not available with prior art cleaners.

The present invention is predicated upon the discovery that tube cleaning is far more effective if scraper blades or bristles contact the inner wall of the tube at an acute angle or in a perpendicular manner, rather than at an oblique angle as is the case with prior art cleaners.

Accordingly, the present invention provides a tube cleaner having at least one scraper means for contacting an inner wall of a tube, the scraper means having one end mounted on or integral with a central core and the other end adapted to contact the tube wall in a non-sealing manner, characterised in that when the cleaner travels through the tube, said other end forms an angle of 90 degrees or less with the tube wall rearwards of said other end.

The scraper means may take many forms. One preferred embodiment will now be described. The or each scraper means is mounted on a central core and the or each scraper means is capable of replacement without damage to the core.

The core may be manufactured from any appropriate material, but preferably is made from a material which provides sufficient body strength to enable the cleaner to scrape hard deposits such as scale from the tube wall. It is also preferred that the core is made from a material which will not bend or break but which will retain its shape, even after hitting an obstruction at speed. One such suitable material is a plastic polymer, for example, some forms of polypropylene. Another is metal, such as steel. Others will be apparent to one skilled in the art, or will be apparent after suitable experimentation.

The diameter of the core may vary according to the diameter of the tube to be cleaned. For example, the diameter of the core may range from 4.5 mm to 63.5 mm or even more. However, as will be appreciated from the description below, it is possible to use one size of core in conjunction with suitably-sized scraper means, to clean a relatively wide range of tube dimensions.

The scraper means may be mounted on the core in any manner which permits the scraper to be effective in operation but replaceable without damaging the core. There are advantages in being able to replace the scraper means without having to replace the core. For example, if one or more scraper means becomes damaged or worn, each may be discarded in favour of a new scraper. In addition, the same core may be used for tubes of different gauges, by replacing the scraper means with other means of lesser or greater diameter.

In one form, the scraper means comprises a split ring of resilient but relatively rigid material, mounted in a transverse channel in the core. If it is desired to replace the scraper means, for example because the scraper means has become worn or damaged, or so as to cater for a tube of different gauge, the existing scraper is pried away from the core and a replacement is snapped on to the core. The split ring configuration has the advantage that if the ring encounters an obstruction such as a scale build up, the pressure on the ring will cause the split to widen, which in turn will increase the diameter of the ring, thus enhancing the scraping action of ring. In addition, if the tube has an oval cross-section, due to sagging or other causes, the split can narrow and the ring may still pass through the tube.

For most applications, the tube cleaner of the invention in this embodiment will include three or four scraper means mounted at intervals along the core. However, if it is desired that the tube cleaner can negotiate bends in the tubes, time cleanser may be relatively short, with only one or two scraper means.

As to suitable material for the scraper means, this is preferably a plastic polymer. It is also contemplated that the scraper means may be made from metal, such as stainless steel, bronze or other suitable material. The tube cleaner of the invention may have on the same core scraper means of different materials—for example, there may be four scraper means, with the first being a plastic polymer, the second being metal, and so on. This form of the invention may have advantages in removing deposits of a wide variety of types.

The scraper means preferably has a sharp edge which presents towards the front of the tube cleaner when in use, so that there will be excellent abrasive action between the scraper means and the wall of the tube and hard deposits will be removed from the wall.

In cross-section, the scraper means may be rectangular, for example, or may have the leading edge sharpened via a taper or arc.

This embodiment of the tube cleaner of the present invention preferably has openings to allow water to pass through the cleaner and to be forced through apertures aimed at the tube wall, so as to loosen deposits, especially soft deposits and to assist flushing of loosened material from the tube.

This may be achieved by having a core which is hollow throughout its length but sealed (or substantially sealed) at the leading end. Each scraper means is mounted in an external transverse groove on the core. In each groove are one, two, three or four apertures, each of which communicates with the hollow bore in the core. (There need not be the same number of apertures in each groove—for example, the groove closest to the leading end of the cleaner may have four apertures, while the others may have only one or two. Each scraper means is fixed in its groove by a peg or other suitable means, and the scraper means are suitably shaped, so that in successive grooves one aperture is available for the emission of water an such apertures are staggered with respect to each other. In each groove, preferably there is at least one aperture opposite the peg or other suitable means fixing the scraper in the groove.

The tube cleaner of the invention may be caused to travel through the tube in various ways. Where the scraper means are mounted transversely on a central core, the tube cleaner will normally be propelled through the tube by hydraulic or pneumatic means such as a water or air gun of sufficient force. A combined hydraulic and pneumatic means may also be used. The gun required may need to be able to exert a force greater than 400 psi to propel the tube cleaner.

Where the tube cleaner of tile invention is used in large-gauge tubes, such as calandria in the sugar refining industry, mains pressure water may be substituted for the gun employed for heat exchanger and condenser tubes. In this embodiment, the cleaner does not have openings to allow water to pass through the cleaner, but incorporates a piston to assist propulsion by means of the mains water pressure.

The invention will now be described in greater detail in connection with the accompanying drawings, in which;

FIGS. 1A, 1B and 1C compare schematically the manner in which the scraper means of one embodiment of the tube cleaner of the invention and the prior art scraper means contact the inner wall of a tube;

Figure 1A:
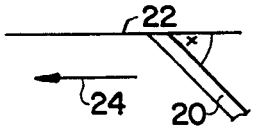

Referring first to FIG. 1A, scraper means 20 (attached to a central core of a tube cleaner of the invention, not shown) contacts tube wall 22 at an acute angle x, which is substantially maintained when the tube cleaner travels through the tube in the direction of arrow 24.

Figure 1B:
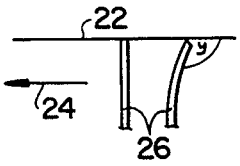
FIG. 1B (PRIOR ART)

FIG. 1B, bristle 26 of a tube cleaning brush, not shown, contacts tube wall 22 in an approximately perpendicular manner when the brush is at rest. However, when the brush travels through the tube in the direction of arrow 24, bristle 26 is forced rearwardly, to form an obtuse angle y with the tube wall 22.

Figure 1C:
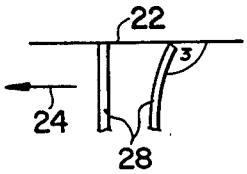
FIG. 1C (PRIOR ART)

In FIG. 1C, blade 28 of a prior art scraper (not shown) contacts tube wall 22 at a right angle when the scraper is at rest. However, when the scraper is forced through the tube, blade 28 is bent rearwardly to form an obtuse angle z with tube wall 22.

Figure 2:
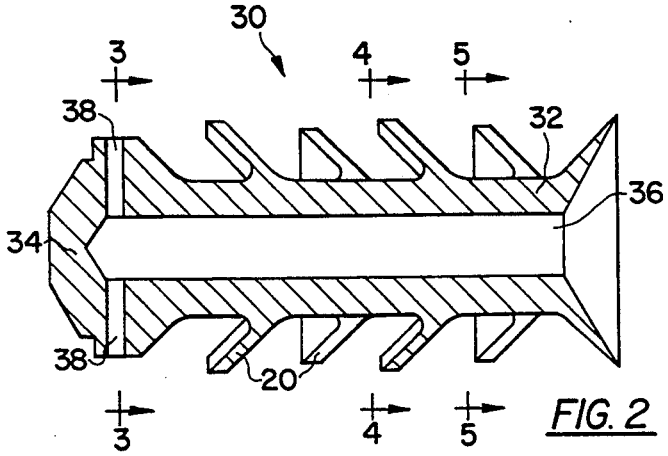
FIG. 2 represents a longitudinal sectional view of an embodiment of the tube cleaner of the invention.
Figure 3:
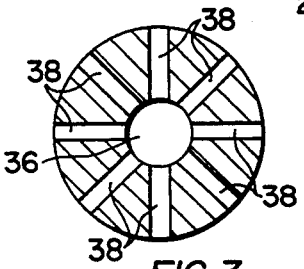
FIG. 3 is a transverse sectional view taken along the lines 3—3 of FIG. 2.

Turning now to FIG. 2, tube cleaner 30 consists of a central core 32 and four concentric scraper means 20. Core 32 also has a core head 34. Central aperture 36 in core 32 communicates with outlets 38 (see especially FIG. 3). When this tube cleaner is propelled through a tube from a water gun, water is forced through aperture 36 and outlets 38 to assist flushing of the tube.

Figure 4:
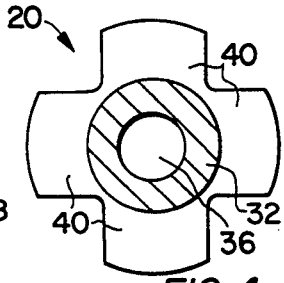
FIG. 4 is a transverse sectional view taken along the lines 4—4 of FIG. 2.
Figure 5:
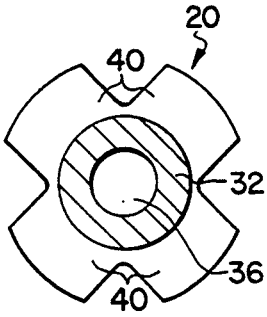
FIG. 5 is a transverse sectional view taken along the lines 5—5 of FIG. 2.
Figure 6:
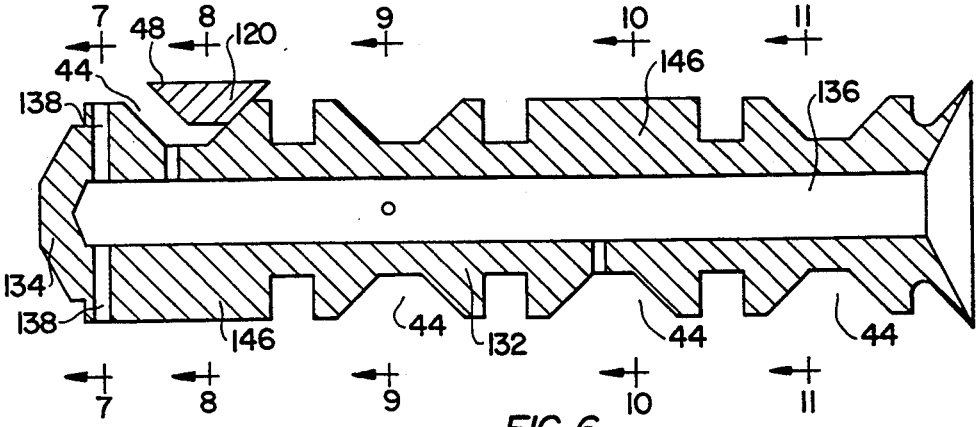
FIG. 6 is a longitudinal sectional view of a second embodiment of the tube cleaner of the invention.
Figure 7:
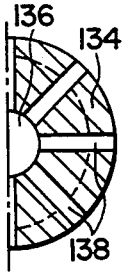
FIG. 7 is a transverse half sectional view taken along the lines 7—7 of FIG. 6.
Figure 8:
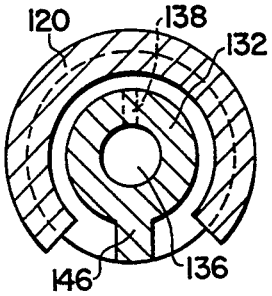
FIG. 8 is a transverse sectional view taken along the lines 8—8 of FIG. 6.
Figure 9:
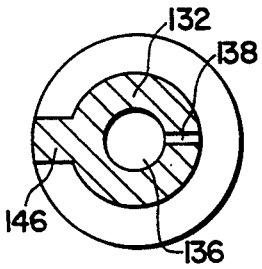
FIG. 9 is a transverse sectional view taken along the lines 9—9 of FIG. 6.
Figure 10:
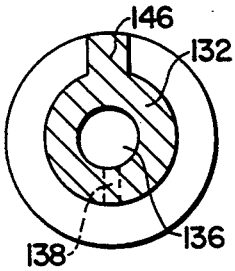
FIG. 10 is a transverse sectional view taken along the lines 10—10 of FIG. 6.
Figure 11:
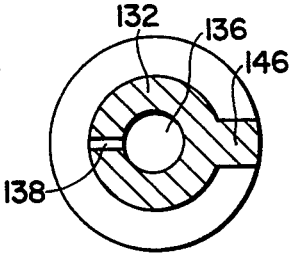
FIG. 11 is a transverse sectional view taken along the lines 11—11 of FIG. 6.

As illustrated by FIGS. 4 and 5, scraper means 20 comprise blades 40, arranged so that each part of the inner circumference of tube wall 22 will be contacted by a blade 40.

The embodiment of the tube cleaner 42 in FIGS. 6 to 11 has a central core 132 made of plastic polymer and incorporates four incomplete transverse channels 44, each terminating at tongue 146.

In this embodiment, the scraper means 20 consists of a split ring of resilient but relatively rigid material (for example, a material which is harder that polyethylene) mounted in each of transverse channels 44. For ease of illustration, only one split ring is shown (see FIG. 8). Tongue 146 nerves to maintain the split ring scraper means 120 in channel 44 and to prevent undue rotation.

A portion only of split ring scraper means 120 is illustrated in FIG. 6, once again for clarity. It can be seen that forward edge 48 will form an acute angle with the tube wall (not shown).

Core 132 has a core head 34 and a central aperture 36 communicating wilt outlets 38, not only in core head 34 but also in channels 44, one such outlet being located opposite each tongue 146. It is of course possible to incorporate additional outlets 138 if desired.

It will be appreciated from the foregoing that the tube cleaner of the present invention may be capable of dealing with hard deposits as well as soft, that it may be made in a form which will not bend or break on collision with a solid obstruction, that it permits great flexibility as to the selection of scraper material and size and has economical advantages, and so represents a significant advance over the prior art.

Other forms of the invention and methods of use will be apparent to one skilled in the art and the invention is not to be limited by the specific examples referred to herein.

I claim:

1. A tube cleaner comprising a central core having a longitudinal axis, and at least two radially extending scraper means for contacting an inner wall of a tube, each said scraper means being mounted on said central core and having a distal portion adapted to contact the inner tube wall in a non-sealing manner, wherein said central core has a hollow bore extending at least partially therethrough substantially parallel to said longitudinal axis, said hollow bore opening onto one end of said central core, said hollow bore further communicating with at least one aperture extending in a generally radial direction from said hollow bore, said at least one aperture opening onto a peripheral surface of said central core for the emission of a fluid, wherein when the tube cleaner travels through the tube, said scraper means forms a forwardly directed angle greater than 90 degrees with the tube wall forward of said scraper means, wherein each said scraper means is replaceable without damaging said core, said distal portion of each said scraper means having a leading edge which faces the front of the tube cleaner when in use, wherein at least two circumferential channels are formed at intervals in said central core, wherein between two and four said scraper means are mounted in a respective circumferential channel.

2. A tube cleaner as claimed in claim 1, wherein said distal portion of said scraper means has a leading edge facing towards the front of the tube cleaner when in use.

3. A tube cleaner as claimed in claim 1, wherein each said scraper means comprises a split ring.

4. A tube cleaner as claimed in claim 3, wherein at least one split ring is made of a plastic polymer.

5. A tube cleaner as claimed in claim 3, wherein at least one split ring is made of metal.

6. A tube cleaner as claimed in claim 3, wherein said split rings are made from different respective materials.

7. A tube cleaner as claimed in claim 3, wherein at least one of said apertures opens to an exterior at one of said circumferential channels.

8. A tube cleaner as claimed in claim 1, which is adapted to be propelled through the tube by one of hydraulic means, pneumatic means and combined hydraulic/pneumatic means.

9. A tube cleaner as claimed in claim 1, wherein said central core is made from at least one of a plastic polymer and a metal.

10. A scraper for use on a tube cleaner having a core with a longitudinal axis, the scraper comprising:

a radially extending annular-shaped member which is replaceably mountable about at least a part of a circumference of the core, wherein, when said annular-shaped member is mounted, said member has a distal periphery adapted to contact a tube wall in a non-sealing manner and a leading edge portion that forms an angle greater than 90 degrees relative to the tube wall in an operational direction of travel;

wherein at least two said annular-shaped members are mountable on the core in respective circumferential channels provided in the core, wherein each said annular-shaped member comprises a split ring, said split rings being each made from different materials, respectively.

11. A scraper as claimed in claim 10, wherein said annular-shaped member is made from at least one of a plastic polymer and a metal.

12. A scraper for use on a tube cleaner having a core with a longitudinal axis, the scraper comprising:

a radially extending annular-shaped member which is replaceably mountable about at least a part of a circumference of the core, wherein, when said annular-shaped member is mounted, said member has a distal periphery adapted to contact a tube wall in a non-sealing manner and a leading edge portion that forms an angle greater than 90 degrees relative to the tube wall in an operational direction of travel;

wherein the core has a circumferential channel formed at least partially therearound, wherein said annular-shaped member comprises a split ring adapted to be mounted in said circumferential channel.

13. A scraper as claimed in claim 12, wherein said annular-shaped member is made from at least one of a plastic polymer and a metal.

* * * * *